US008011855B2

(12) United States Patent
Bonds

(10) Patent No.: US 8,011,855 B2
(45) Date of Patent: Sep. 6, 2011

(54) ROADWAY-LEVEE

(76) Inventor: Ronald Scott Bonds, Sierra Madre, CA (US)

( * ) Notice: Subject to any disclaimer, the term of this patent is extended or adjusted under 35 U.S.C. 154(b) by 0 days.

(21) Appl. No.: 11/784,608

(22) Filed: Apr. 7, 2007

(65) Prior Publication Data

US 2008/0247825 A1 Oct. 9, 2008

(51) Int. Cl.
*E04H 17/00* (2006.01)

(52) U.S. Cl. ..... 405/115; 405/114

(58) Field of Classification Search ..... 405/109, 405/113, 115, 107, 114; 256/13
See application file for complete search history.

(56) References Cited

U.S. PATENT DOCUMENTS 4,375,929 A * 3/1983 Clark ..... 405/114
4,458,456 A * 7/1984 Battle ..... 52/63
5,470,177 A * 11/1995 Hughes ..... 405/115
5,645,373 A * 7/1997 Jenkins ..... 405/91
6,450,733 B1 * 9/2002 Krill et al. ..... 405/114
7,303,358 B1 * 12/2007 Fuller ..... 405/114
2002/0114666 A1 * 8/2002 Uchida et al. ..... 403/401
2006/0124913 A1 * 6/2006 Keedwell ..... 256/12.5

FOREIGN PATENT DOCUMENTS

FR 2876716 A1 * 4/2006
WO WO 9704177 A1 * 2/1997

* cited by examiner

*Primary Examiner* — Sunil Singh

(57) ABSTRACT

A water or flood control and containment system is provided having foundations, sealed bases, supporting structure, and pumping system that gives the user control over water containment and movement either to reduce the water hazard or to store water. The bases are secured and sealed to paved surfaces with foundations that have been preset into the street or other prepared foundation. When deployed on multiple adjacent streets, the system creates a compartmented barrier containment system that mitigates flooding and storm surges. The invention is to be removed and stored off site when not in use.

13 Claims, 23 Drawing Sheets

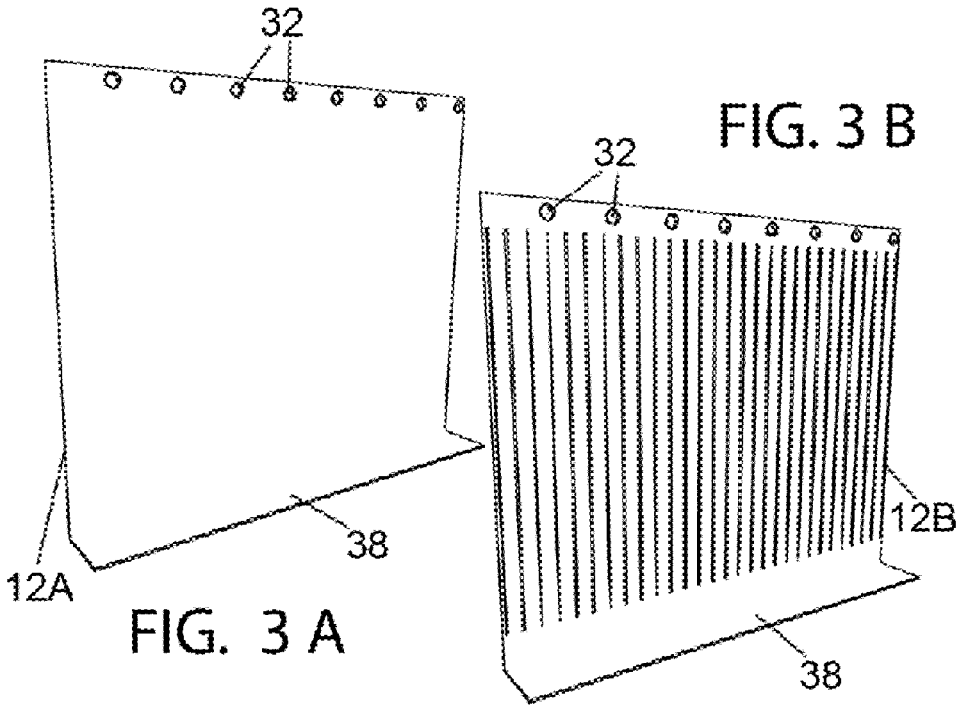
FIG. 3 A
FIG. 3 B
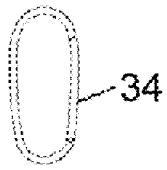
FIG. 3 E
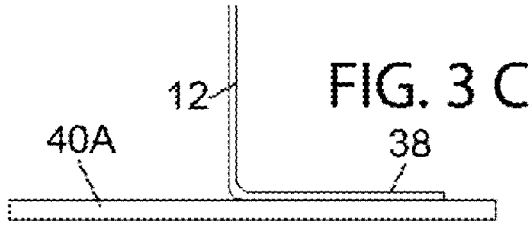
FIG. 3 C
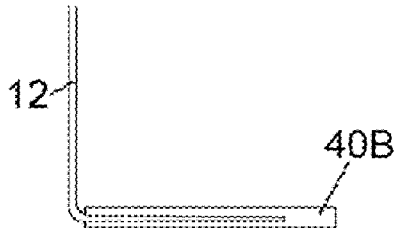
FIG. 3 D FIG. 15 A
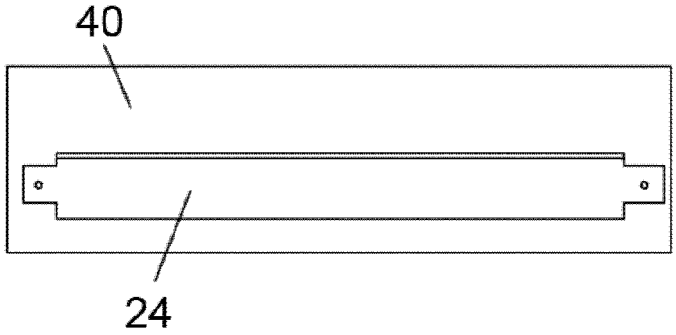
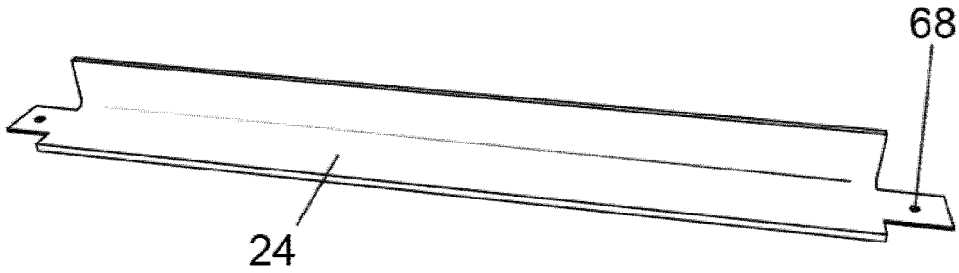
FIG. 15 B FIG. 20 A
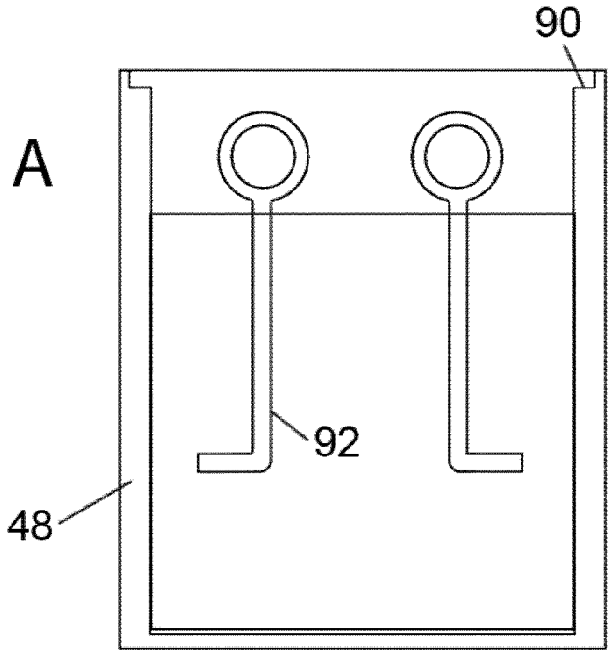
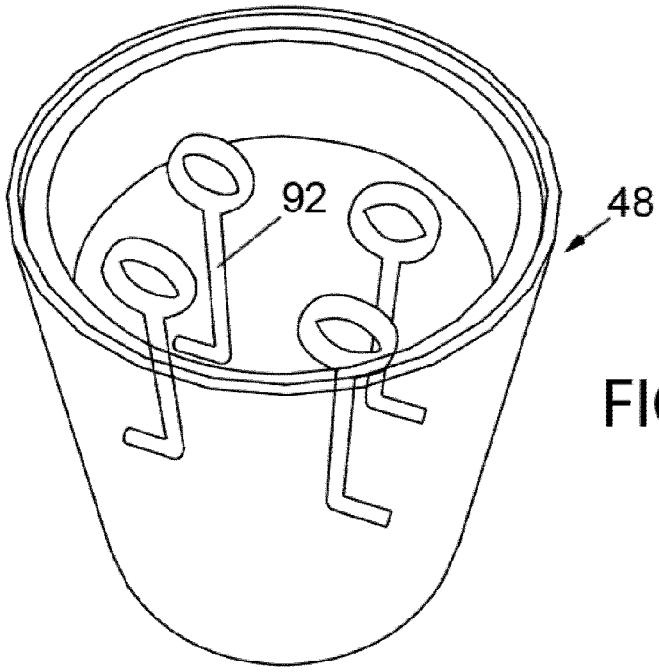
FIG. 20 B

ROADWAY-LEVEE

BACKGROUND AND OBJECTIVES OF MY INVENTION

Periodic flooding of bodies of water has caused serious destruction and loss of life and property. In areas where flooding recurs, dams and levees have been built to contain rising waters. Sometimes theses are sufficient, but more often they are not and the water rises above the levees or is too powerful to be contained and breaks through them.

There have been many patents for portable dams developed for use in and alongside riverbeds and other waterways, but little has been done to devise portable means to stem the rise of floodwaters other than the use of sandbags. Some inventors have utilized water, sand, gravel, or earth as ballast that are essentially large bags filled with some kind of ballast material. Those include:

Serota, in U.S. Pat. No. 3,213,628 teaches the use of plastic containers in the shape of a rectangular solid which can be filled with water and lashed together to form a wall or barrier. The device of Serota is best used in a gorge or similar passageway.

Jackson, III, (U.S. Pat. No. 4,692,060) teaches an elongated water filled tube with side panels in the shape of an equilateral triangle. The tubes are surrounded by wooden frames fastened through loops in the sides of the tubes. The frames are used for support and to help in maintaining the triangular shape of the tubes when filled. A similar device was developed by Coffey (U.S. Pat. No. 4,921,373), but he emphasizes an A-frame structure which can be made from highway or construction barriers. A flexible tube with triangular cross-section is supported by the frame and filled with water. The units can be placed end to end to extend the wall as needed. Velcro strips on the ends of the tubes facilitate fastening the units together.

Another long tubular container (can be 100 feet long) with triangular cross-section was developed by Hendrix (U.S. Pat. No. 5,040,919). The device of Hendrix is not in the form of an equilateral triangle, but one having sides of three different lengths. A skirt is attached to the container along the lower front edge to form a seal with the ground to prevent the rising waters from flowing under the unit. This device uses no outside support, but is very heavy when filled with water. Additional units can be placed end to end to provide a long wall. These units cannot be stacked.

Another approach to the portable module as a flood barrier was taken by Taylor in U.S. Pat. No. 4,981,392. Taylor's module consists of two cylindrical chambers to be filled with water. The modules can be made in varying lengths. They can be placed side-by-side and/or stacked. A staggered stacking pattern can produce a barrier of considerable height and thickness. End to end placement results in a wall of any desired length. There is no mention of a ground seal or any means to prevent the floodwater from passing beneath the modules.

Another method to the portable module as a flood barrier was taken by Hughes in U.S. Pat. No. 5,470,177. Hughes' module consists of compartmented ballast cells that are to be filled with water, sand, gravel, earth, or other such material. The modules are held in place with lightweight support struts and have a waterproof cover that can be armored to prevent penetration by debris.

Clark in U.S. Pat. No. 4,375,929 devised another method of flood protection. Clark's module is comprised of metal panels sealingly attachable to one another to form a continuous barrier around a building structure, and sealed with gaskets and attached to a concrete fixed foundation surrounding the structure, and is also abut against the building in order to spread the force of the flood water against the dam structure.

All of the aforementioned devices may be effective in varying degrees in the path of rising water if the water is not too high, is not coming in rapidly and is not moving with great force. There is still a need for a strong, flexible, portable, continuous barrier of lightweight, water resistant materials that enables its users to erect it quickly and easily using infrastructure that is already in place in both urban and rural areas, giving the user control over water containment and water movement without the hardship and cost of moving and placing vast amounts of sand, water, earth, gravel or other heavy materials that require prodigious amounts of manpower and machinery to place in the short amount of time that containment and control is needed.

My invention relates to the use of roadway-levees that mitigate flooding, storm surges, and other times when excess water is present in urban or rural areas.

Damage from floods results from a combination of the great power of flowing water and the concentration of people and property in floodplains, along rivers, and coasts. In the United States over 3,800 towns and cities of more than 2,500 inhabitants are on floodplains. Damaging floods result when the volume of river flow exceeds levels of flood preparedness, either because flow is greater or longer than expected or because of incomplete understanding of local hazards. Roadway-levees are designed to mitigate flood damage.

The current technology for protecting cities and towns from flooding consists of massive levees and dams. That technology relies on the force of gravity on large, heavy structures made of concrete, and/or earth, and/or sand, and/or gravel. The masses of those structures prevent water from flooding the areas being protected. My roadway-levee uses the same technique in a different form by using the mass of roadways and other cemented or paved surfaces as the underlying foundation or base for holding down and sealing water-resistant barriers.

Levees are built around or adjacent to populated areas like New Orleans in order to protect them. The current designs are one-wall designs. One-wall designs are like the Titanic, which had one steel layer to hold out seawater. The flaw of one-wall designs is that when a one-wall levee is breached, the entire area behind the levee is flooded, just like the Titanic was flooded and sank. The best solution is to have back-up levees such as my roadway-levee to back-up the large massive levees. In many cases where the floodwater is shallow, only roadway levees may be needed, instead of massive one wall concrete levees and dams.

The primary locations for my roadway-levee invention are on the roadways, streets, driveways, sidewalks, and other surfaces that enable roadway levees to be sealed against water leakage. The installation of my roadway-levees on dirt roadways can be made practicable with the use of the installation of lateral concrete and steel foundations surrounding the area to be protected from flooding.

Roadways can act as a base of my roadway-levee system and offer the ability to compartmentalize flooding thereby greatly mitigating flood damage. Roadway-levees reduce the spread of floodwaters because of their location and the manner and materials of which they are constructed. Each "city block" or other structures such as government buildings, office buildings, industrial plants or buildings, residential buildings, shopping centers, stadiums, retail buildings, hospitals, etc. is to be surrounded by a separate roadway-levee compartment to prevent floodwater from entering the protected area. In conjunction with other roadway-levee-protected areas with the water resistant barriers being deployed along the city streets and being sealed to each other at street intersections, floodwater damage will be mitigated.

BRIEF DESCRIPTION OF DRAWINGS

FIG. 3A shows a plain water barrier; FIG. 3B shows a ribbed water barrier;

FIG. 3C shows the barrier on top of a seal, and FIG. 3D shows the barrier inserted into a slot cut into the seal.

FIG. 3E shows a carabineer used to hold the barrier in a vertical position suspended from a horizontal rod.

FIG. 15A is a top view of one of the bottom rails connecting adjacent vertical posts, and FIG. 15B is a perspective view of the bottom rail.

FIGS. 20A and 20B are respective side cut-away and perspective views of a mechanical foundation with embedded anchor bolts that may be installed beneath the surface of the roadway prior to flooding.

DETAILED DESCRIPTION OF PREFERRED EMBODIMENT

Figure 1:
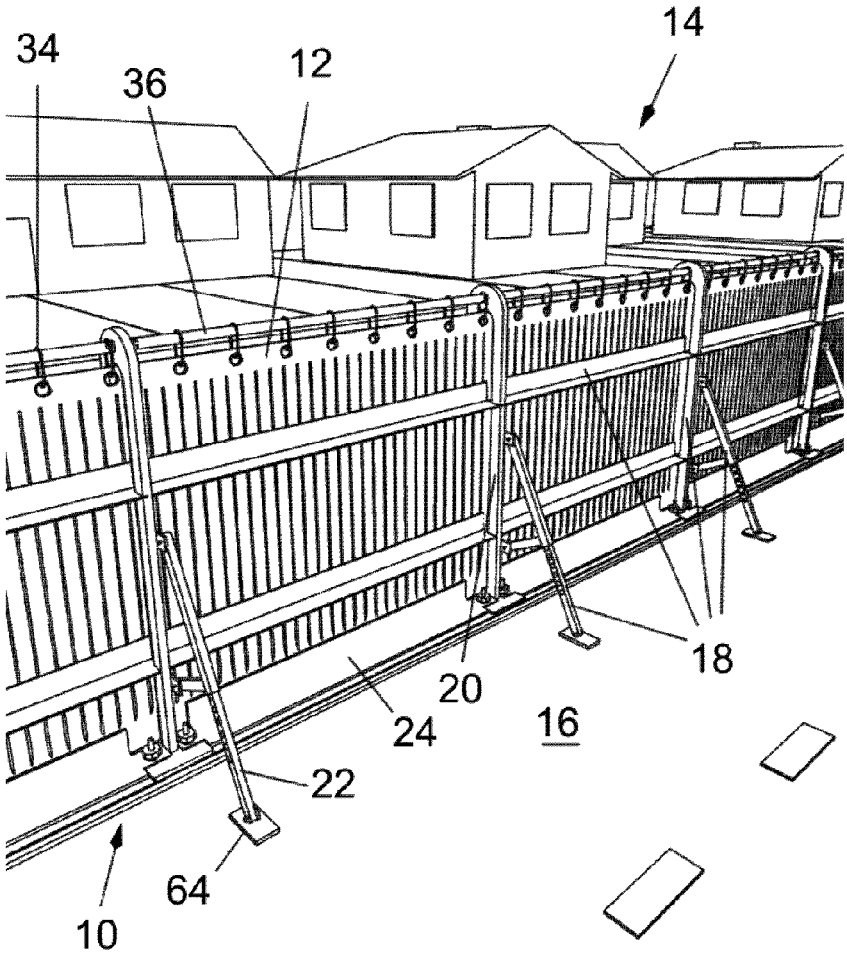
FIG. 1 shows a perspective view of a portion of a Roadway-levee with its water-resistant barrier.

FIG. 1 shows a perspective view of a portion of a deployed Roadway-levee 10 with its water-resistant barrier 12 protecting an enclosed area 14 within and/or surrounding a city/town from flooding. The preferred embodiment shown in FIG. 1 shows the water-resistant barrier sealed to the street surface 16 inhibiting water leakage on either side of the roadway-levee from leaking to the other side of the water-resistant barrier, with the barrier being held upright by scaffolding 18 including a plurality of vertical posts 20 and lateral supports 22, and held against the street surface 16 with horizontal bottom rails 24.

Figure 2:
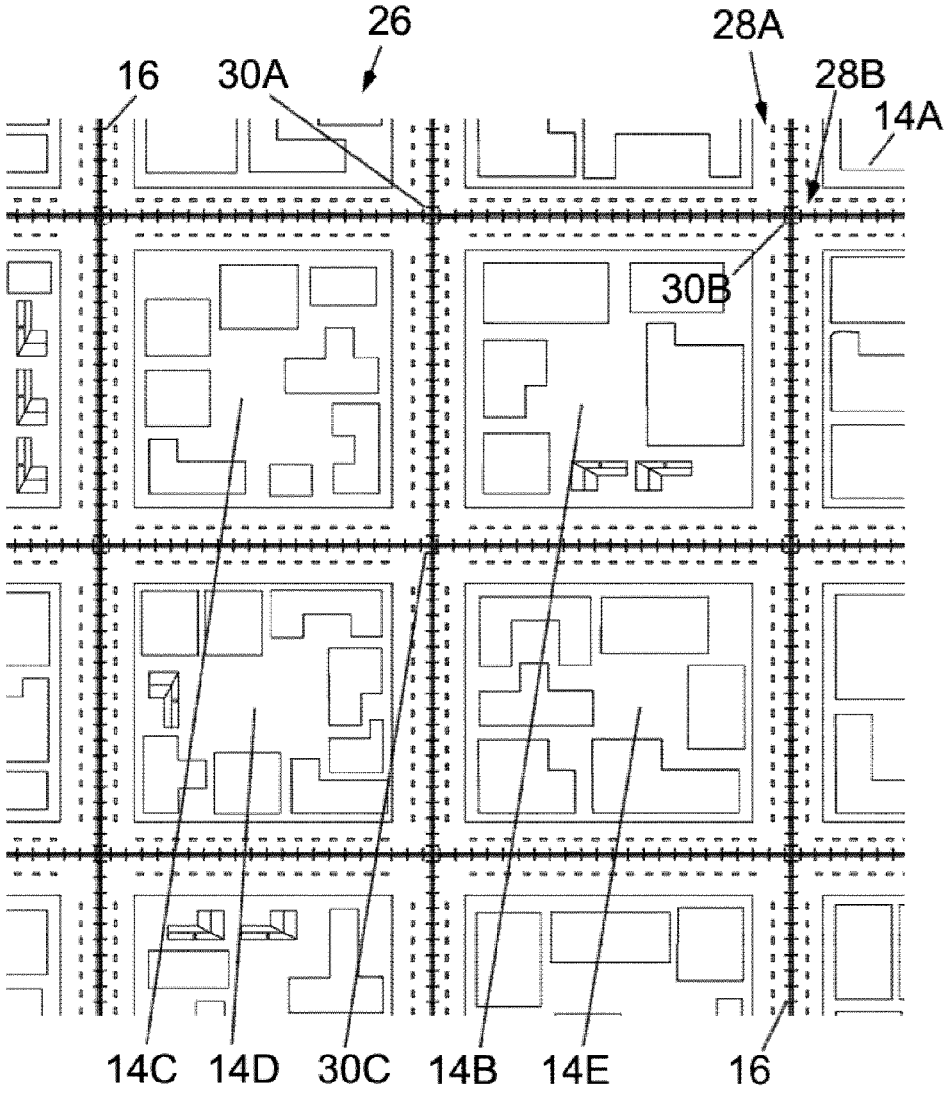
FIG. 2 is an aerial view of a compartmentalized Roadway-levee system within and/or surrounding a city/town.

FIG. 2 shows an aerial view of a deployed Roadway-levee 10 that is protecting a large enclosed area within and/or surrounding a city/town 26 from flooding. The roadway-levees are preferably deployed over the same grid as the intersecting city streets 28A,28B in such a way so that water movement from any roadway-levee protected area 14A to another 14B is greatly reduced. As best seen in FIG. 18, pumps XX may be installed at selected intersections 30A,30B to enable any water within the roadway-levee system to be pumped out from one block 14B into any of the three adjacent blocks 14C,14D,14E radiating from the same intersection 30C, thereby mitigating flood damage.

The gridded Roadway-levee design of FIG. 2 thereby uses compartmentalization with multiple temporary levees 10 to prevent water from inundating populated areas. Roadway-levees can act as backup devices to large concrete or earth base levees.

The location of the roadway-levee can be on any surface that can be sealed. By sealed, it is meant that the roadway-levee seal leaks very little. Some leakage can be expected. The surfaces can include but are not limited to streets, sidewalks, alleys, driveways, or even a roadway-levee foundation surrounding a house(s), hospital(s), government buildings, office buildings, industrial plants and/or buildings, and/or other valuable structures.

A roadway-levee foundation can be anything that allows the seal to work properly that is to prevent or reduce water leakage from one side of the device to the other, and as shown in FIG. 2, is preferably integrated with the street surfaces of intersecting streets defining a gridded arrangement of the areas to be protected.

The Roadway-levee core component is the water-resistant barrier 12. FIG. 3A shows a plain water barrier 12A without internal or external supports. The top of the water-resistant barrier 12,12A has holes 32 for attaching carabineers 34 (see also FIG. 3E) that attach the water-resistant barrier 12 to the rod 36 onto which the water-resistant barrier is hung. The water-resistant barrier 12 is made of material that can resist the weight of standing and flowing water against it. It is resistant to tearing or stretching; and is resistant to water leaking through it.

The bottom portion 38 of the water-resistant barrier 12 lies on top of or is inserted into the bottom seal 40. Carabineers 34 are used in the preferred embodiment due to their ability to hold weight. Other types of hangers may be used in their place.

FIG. 3B shows an alternative design of a water-resistant barrier 12B with vertical ribs 42 inserted into it or attached to the surface of the water-resistant barrier.

FIG. 3C shows the water-resistant barrier 12 on top of a bottom seal 40. It can be attached to the seal mechanically, or with water resistant glue or both. The purpose of the connection of the water-resistant barrier to the bottom and side seals (FIG. 6) is to create a water-resistant barrier from the roadway surface 16 to several feet up in the air and many hundreds of feet long, thereby protecting an area from flooding.

FIG. 3D shows the water-resistant barrier 12 inserted into a slot 44 cut part way into the bottom seal 40. It can be attached to the seal mechanically, or with water-resistant glue or both. The purpose of this method is to create a connection of the water-resistant barrier to the bottom and side seals in such a way as to create a "one-piece" construction of the seal with the water-resistant barrier enhancing its ability to create a water-resistant barrier from the roadway surface to several feet up in the air and many hundreds of feet long, thereby protecting an area from flooding.

FIG. 3E shows a carabineer 34 that is used to hang the water-resistant barrier 12 from the rod 36, which holds the water-resistant barrier 12 in a vertical position giving it support in that position. In the preferred embodiment such devices are used because they are readily available and are engineered to withstand great force, and they can be installed and taken down quickly and easily due to their clip-on design. However, other types of clips may be used as well.

Figure 4A:
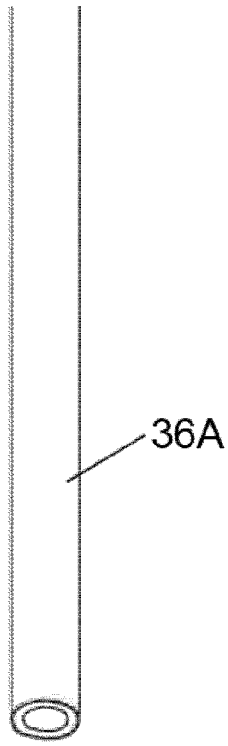
FIGS. 4A shows a straight rod, and 4B shows a corner rod.
Figure 4B:
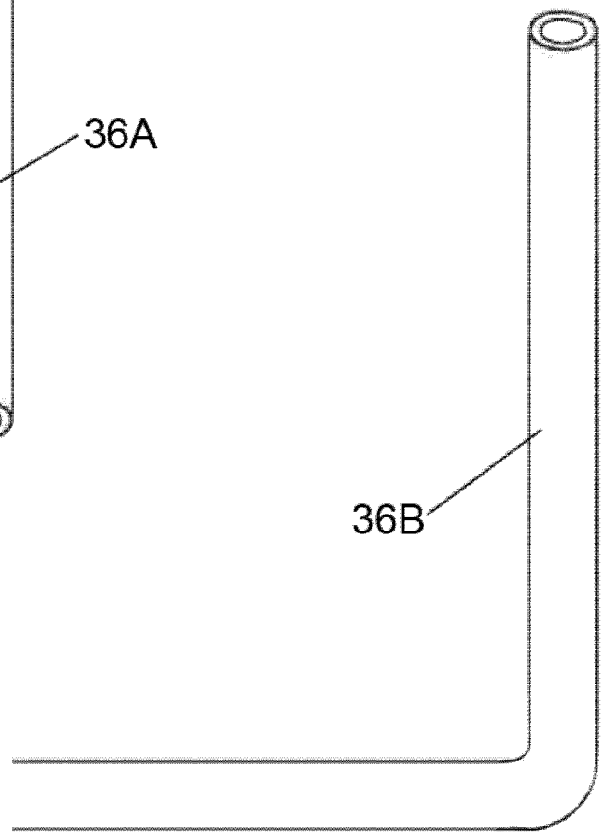
Figure 7:
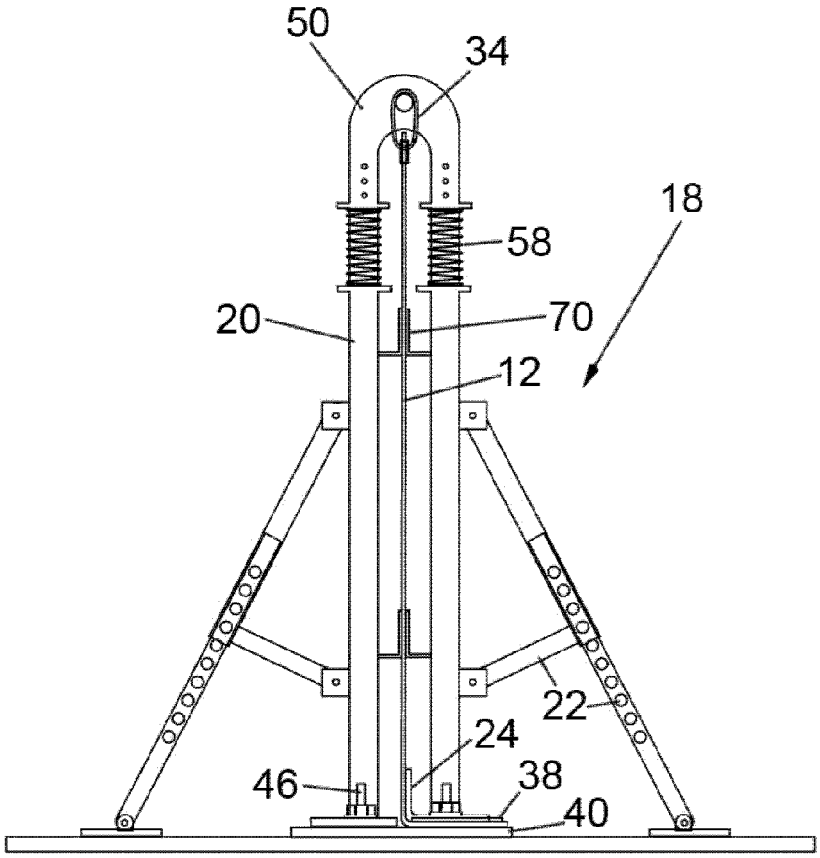
FIG. 7 shows a water-resistant barrier held upright by scaffolding including a vertical post with a lateral support extending downwardly on either side of the barrier.

In the preferred embodiment, straight rods 36A and/or curved rods 36B may be used to hold up the water-resistant barrier 12 between the vertical posts 20 or scaffoldings 18. FIG. 4A and FIG. 4B show two types of rods 36A,36B. As best seen in FIGS. 7 though 9, rods 36 go through holes 52 in the adjustable post top 50 (see also FIG. 9). The post top 50 holds up the rod 36, which holds the water-resistant barrier 12 vertically. FIG. 4A shows a straight rod 36A and FIG. 4B shows a corner rod 36B, which makes a 90-degree turn.

Figure 5A:
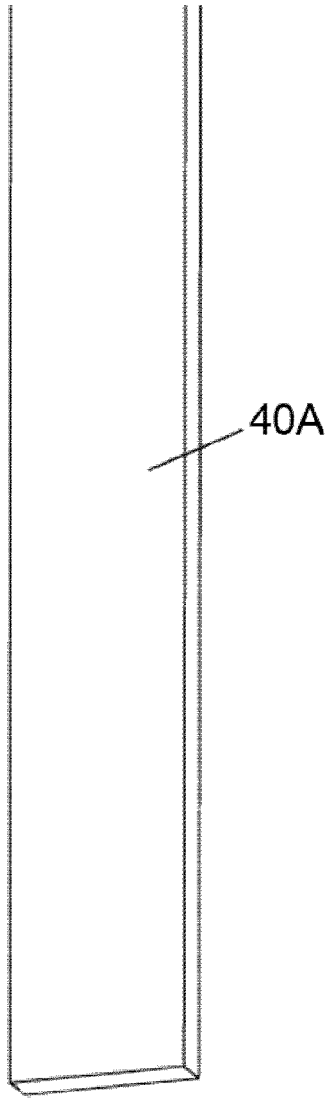
FIG. 5A shows a plain seal.
Figure 5B:
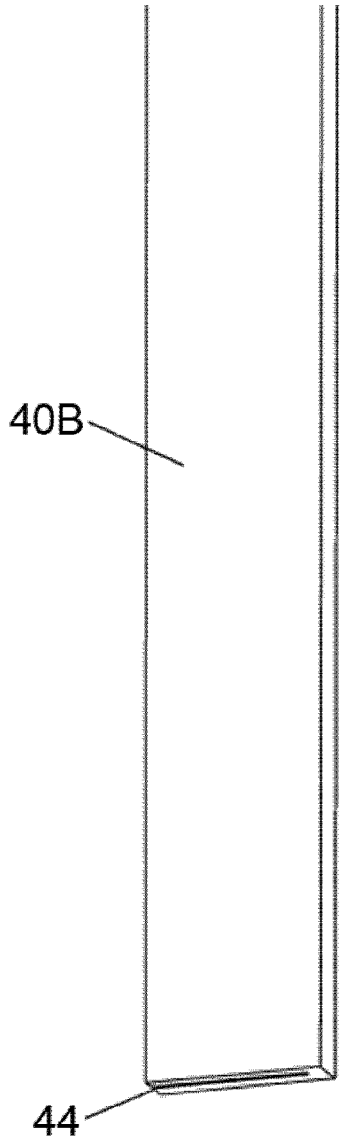
FIG. 5B shows a slotted seal.

FIGS. 5A and 5B show alternative embodiments of a bottom seal 40. The purpose of the bottom seal is to prevent water from leaking underneath or around the roadway-levee 10. The seal is made of a rubber-like pad that, when compressed by trusses and laterals or glued to the roadway surface, conforms to the paved surface and thereby prevents water from leaking under the roadway-levee thereby creating a water-resistant seal. It is made of materials that allow it to be compressed mechanically or to be glued onto the roadway surface. It is thick enough to allow it to conform to the underlying street surface with all of its imperfections thereby creating a seal. The seal may or may not have water-resistant glue that adheres to the bottom of the seal to the paved surface. It may do this sideways or lengthways. In any case it will resist water leakage as long as the roadway is constructed to normal construction standards. It may be made out of natural materials, fibers, metal supports, such as rubber or man-made such as plastic or other man-made materials or combinations thereof. FIG. 5A shows a plain bottom seal 40A with no slot or holes.

FIG. 5B shows a bottom seal 40B with a slot 44. The purpose of the slot 44 is to allow a water-resistant barrier 12 to be inserted into it. The purpose of this method is to create a connection of the water-resistant barrier to the bottom and side seals in such a way as to create a "one-piece" construction of the seal with the water-resistant barrier thereby enhancing its ability to create a water-resistant barrier from the roadway surface to several feet up in the air and many hundreds of feet long, thereby protecting an area from flooding.

Figure 6:
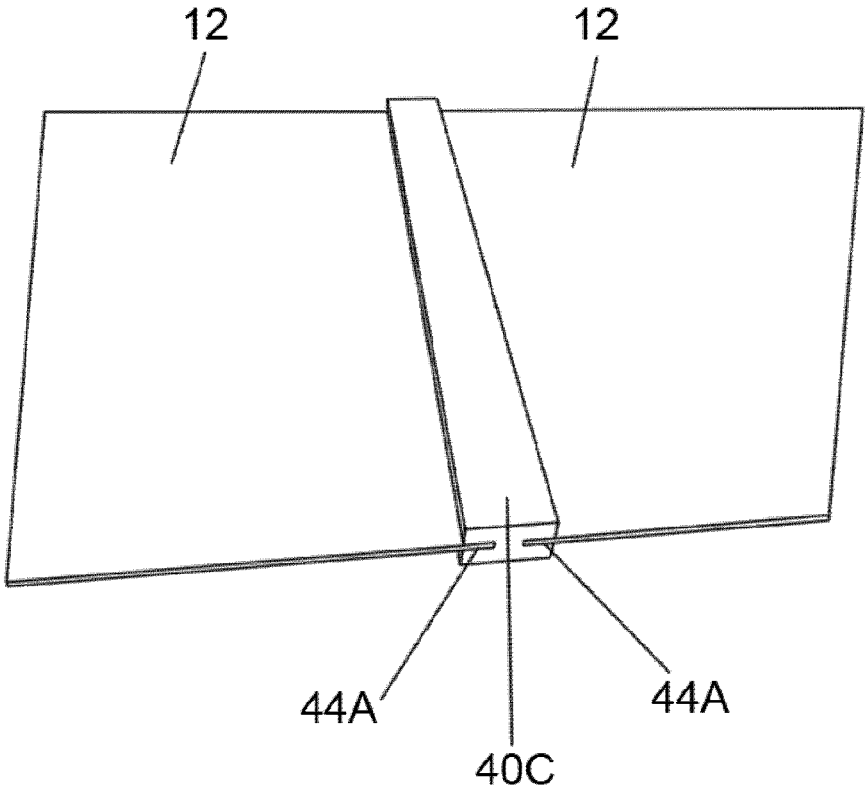
FIG. 6 shows a side seal connecting two adjacent barriers.

FIG. 6 shows a cut-away view of a side seal 40C, where a seal used to connect two water-resistant barriers 12 on either side of it has a pair of slots 44A cut into it, allowing the insertion of seal on both sides, thereby allowing two water-resistant barriers 12 to be connected lengthwise, thereby expanding the length of the barrier. The water-resistant barrier 12 connected in this way may be glued or mechanically sealed to the seals 40A,40B,40C so that no water leaks, in around or under the assemblage.

FIG. 7 shows a more detailed side view of a water-resistant barrier 12 that is held upright by scaffolding 18 including a vertical post 20 with a lateral support 22 extending downwardly on either side of the barrier. The Roadway-levee and laterals are held down to the pavement by anchor bolts 46 set Into the foundations and/or with water-resistant glue, which have been placed into or onto paved surface(s) before or during flooding. The combination of the vertical posts 20, the lateral supports 22, and the bottom rails 24 (see also FIGS. 15 and 16) hold down and compress the bottom 38 of the water-resistant barrier 12 onto or in the seal 40 thereby sealing the water-resistant barrier to the roadway's or foundation's surface 16.

The water-resistant barrier may be glued onto or into the seal making the seal and water-resistant barrier one constructs thereby reducing the possibility of leaks. FIG. 7 shows a side view of a deployed Roadway-levee 10 with its water-resistant barrier 12 that is sealed to the street surface 16 with water-resistant glue, and is held vertically by the vertical posts 20 and lateral supports 22, thereby inhibiting water leakage on either side of the roadway-levee from leaking to the other side of the water-resistant barrier.

Figure 8:
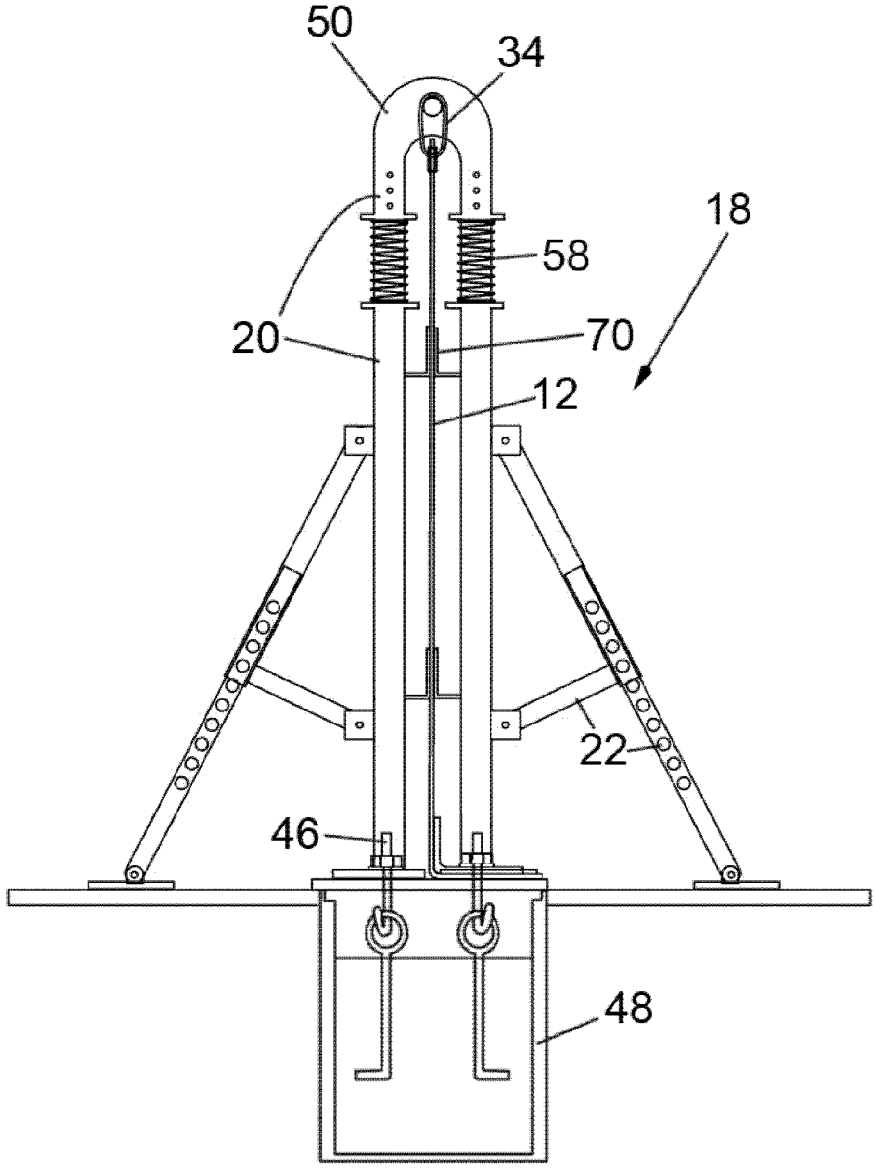
FIG. 8 shows a side view of a deployed roadway-levee sealed to roadway surfaces with hold-down devices.

FIG. 8 shows a side view of a deployed roadway-levee scaffolding arrangement 18 holding up the water-resistant barrier 12 that is sealed to roadway surfaces 16 with hold-down devices consisting of concrete and steel foundations 48, anchor-bolts 46, with or without water-resistant glue. The scaffoldings 18 hold the water-resistant barrier up vertically, thereby inhibiting water leakage on either side of the roadway-levee from leaking to the other side of the roadway-levee.

Figure 9A:
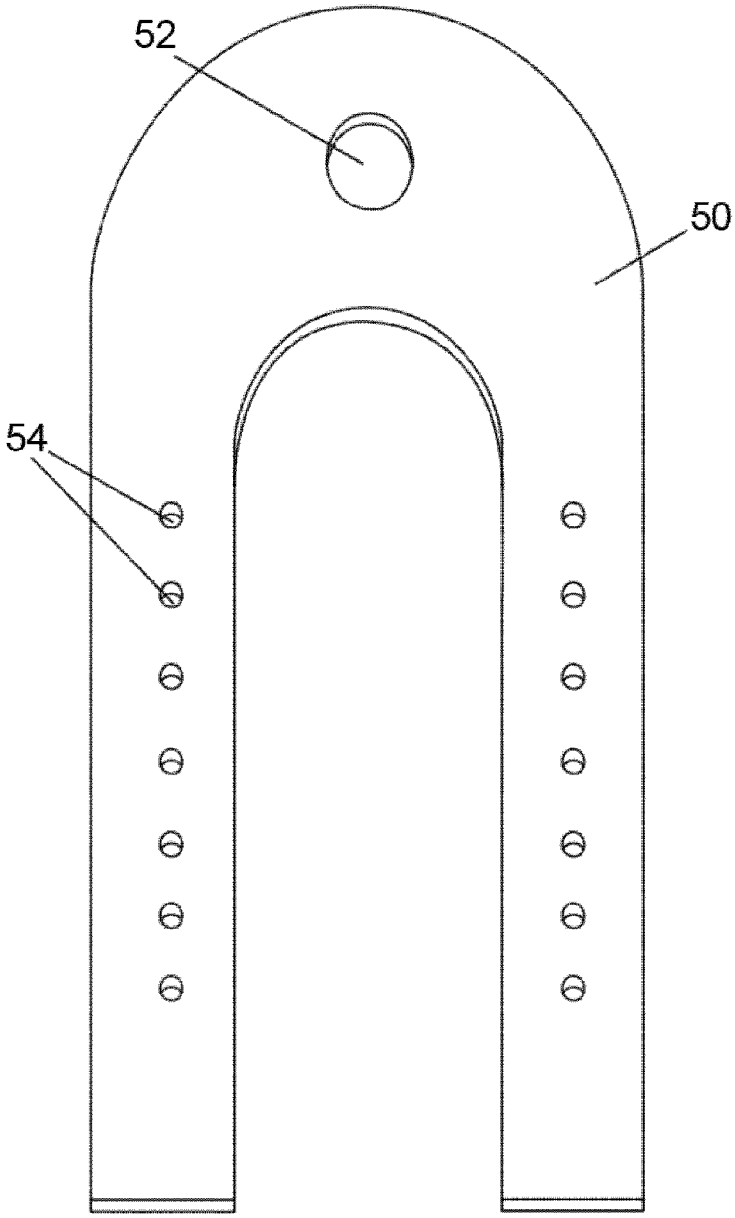
FIG. 9A shows an adjustable post top.
Figure 11:
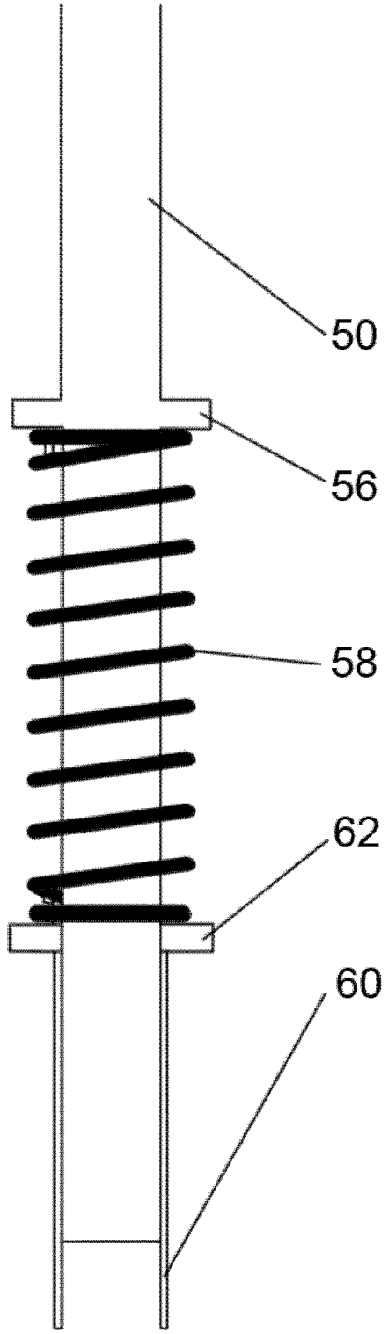
FIG. 11 shows the post top inserted into the post with the spring held between the top pin and a bottom pin welded onto the post body.

FIG. 9A shows an adjustable post top 50. The top hole 52 is for the insertion of the rod 36 that holds up the water-resistant barrier 12. The smaller holes 54 (see also FIG. 9C) are for the insertion of the spring pin 56. As best seen in FIG. 11, spring 58 is to push up on the adjustable post top 50 into which the rod 36 is inserted relative to the lower post body 60. This pushes up on the rod 36 and holds the water-resistant barrier 12 vertically exerting constant pressure on it vertically.

Figure 9B:
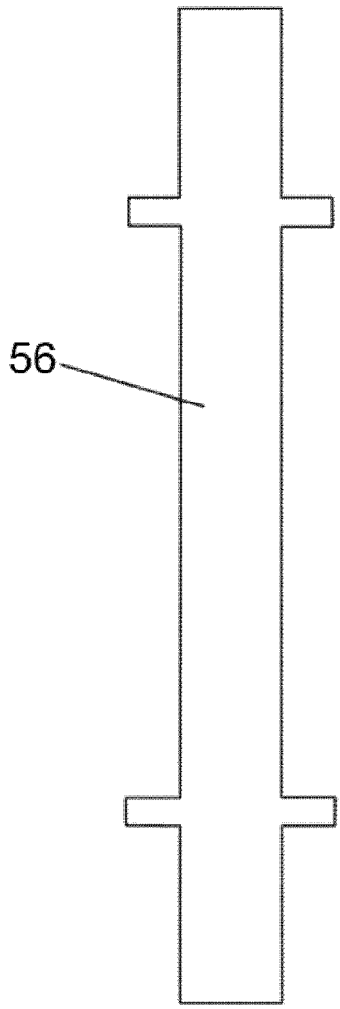
FIG. 9B shows a post top spring pin.

FIG. 9B shows a post top spring pin 56. The purpose of the pin is to serve as the pressure point for the spring 58. It may be inserted into the post top at different points to allow for variations in topography of the roadway, and different heights of water-resistant barriers.

Figure 9C:
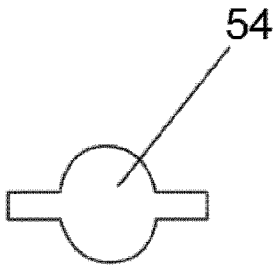
FIG. 9C shows a cross section of the spring-pin

FIG. 9C shows a spring pinhole 54 on the post top which corresponds to the cross section of the spring-pin 56 that is to be inserted into it. The slots allow for the insertion of the pin through the truss top when it can be turned thereby locking into place so it won't fall out.

Figure 10:
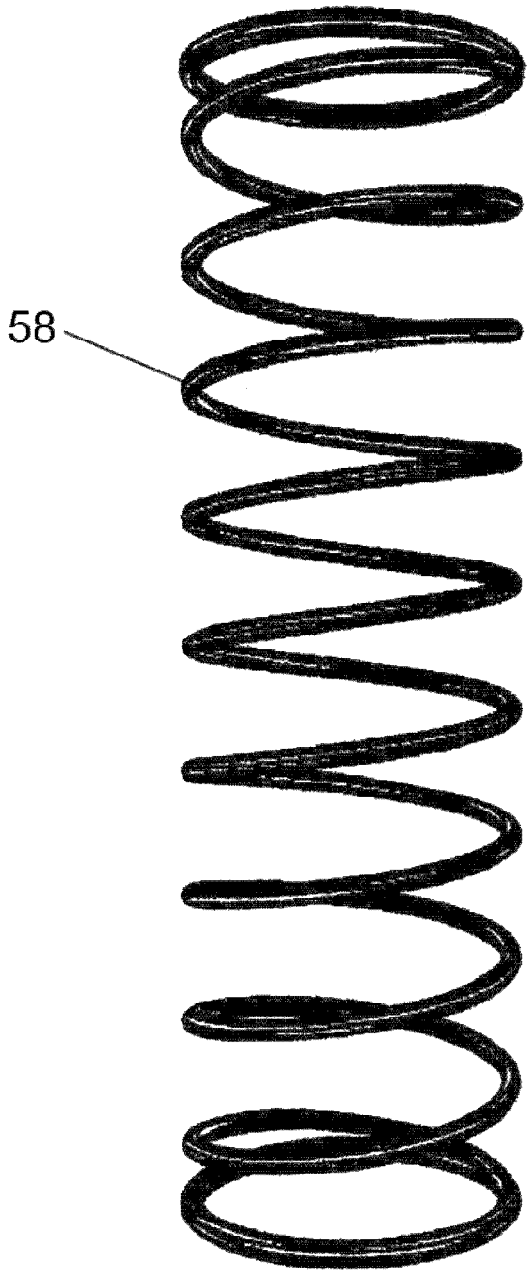
FIG. 10 shows a spring.

FIG. 10 shows a spring 58. The purpose of the spring is to push up on the post top 50 from the main body 60 of the vertical post 20 thereby creating upward pressure on the water-resistant barrier 12, holding it vertically and resisting the lateral pressure of water pressing against it on one side or two sides.

FIG. 11 shows the main body 60 of the vertical post 20 which defines the base or bottom portion thereof and into which the post top 50 is inserted. A fixed pin 62 welded onto the post body 60 acts as a base for the spring 58. The spring goes up to the adjustable post top pin 56.

Figure 12:
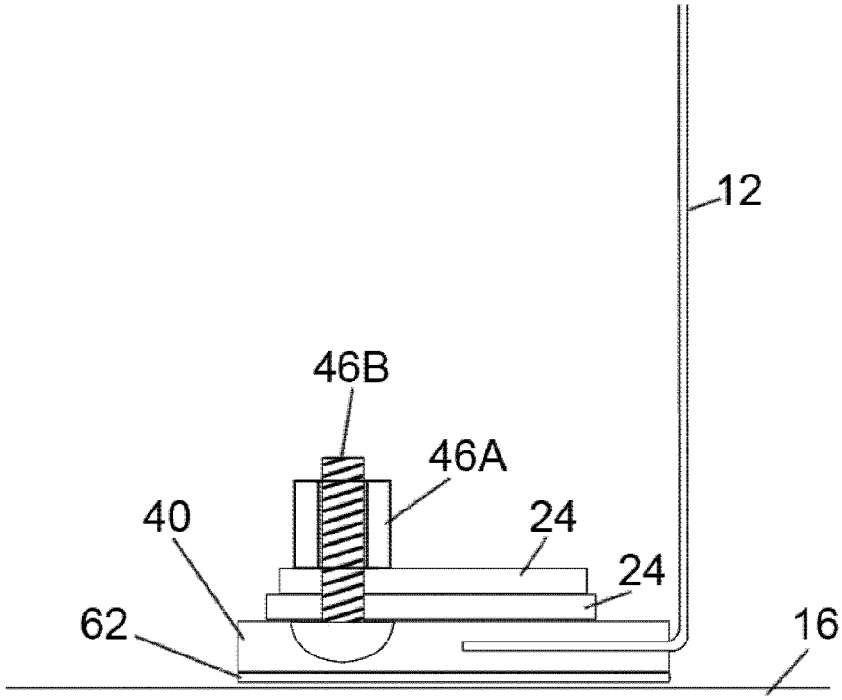
FIG. 12 shows a water-resistant barrier inserted into a seal glued to the roadway surface.

FIG. 12 shows a water-resistant barrier 12 inserted into a bottom seal 40. It also shows a nut 46A and bolt 46B coupling the seal 40 to two adjacent horizontal bottom rails 24 (see also FIG. 7). In this case the seal is glued by a layer of glue 62 to the roadway surface 16. The glue is water-resistant glue that allows the system to be installed before, during, or after flooding. The strength of the glue enables the roadway levee to be attached to the roadway surface creating a water-resistant seal.

Figure 13:
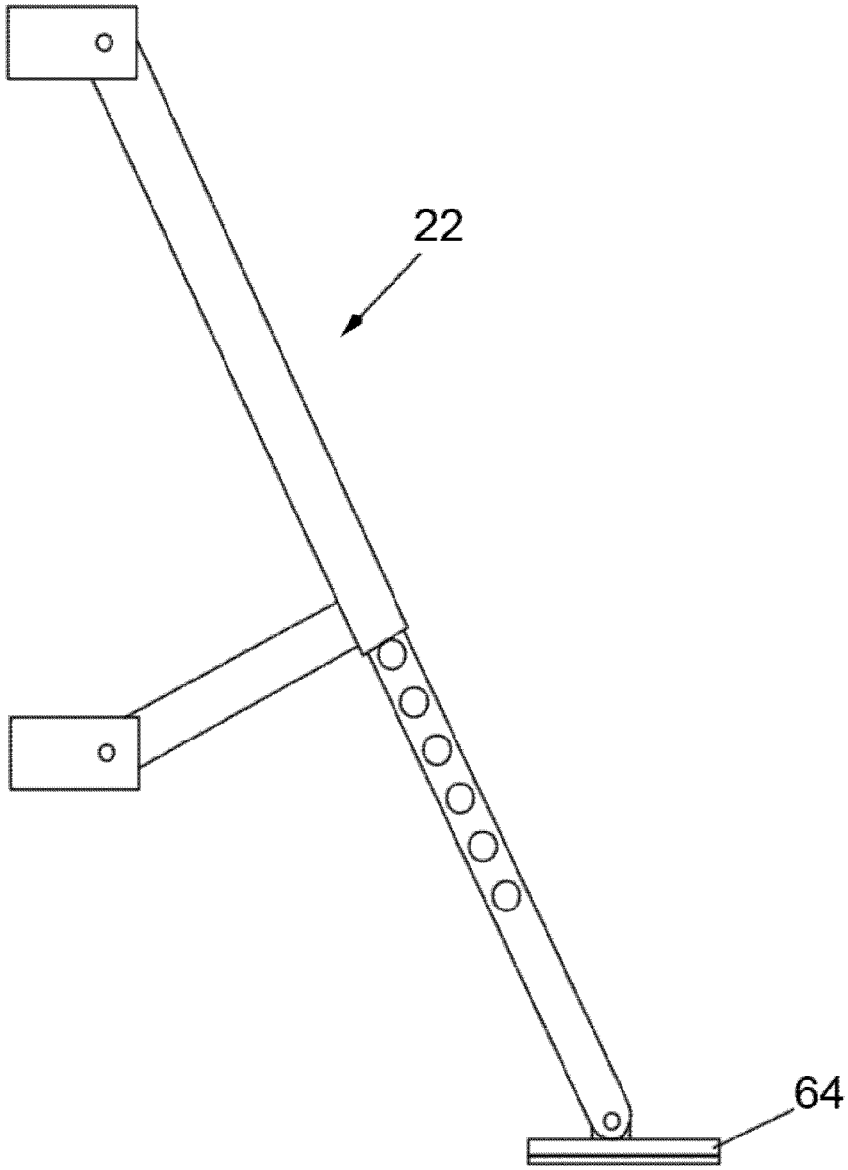
FIG. 13 shows the adjustable lateral support.

FIG. 13 shows the adjustable lateral support 22, which as best seen in FIGS. 7 and 8 is attached to the vertical post at the mid-level of the post and at a vertically spaced second height. The purpose of the lateral support is to support the posts in a vertical position when water is on either or both sides of the roadway-levee. Water is heavy and the force of stationary or moving water will place substantial lateral force on the post making a lateral support highly desirable but not necessarily always required on both sides of all the posts. The hold-down bolts will transfer much of the lateral force of the water to the foundation of the roadway-levee.

Figure 14:
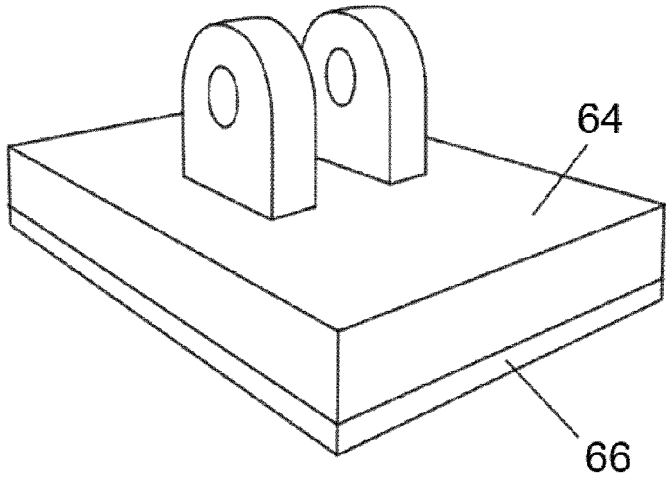
FIG. 14 is a perspective view of a lateral support foot.

FIG. 14 is a perspective view of a lateral support foot 64 with a rubber-like sole 66. The foot of the adjustable lateral support will be made of metal, plastic, or other hard material. The rubber-like sole 66 may be used but is not required. The purpose of the rubber-like sole 66 is to allow for compression so that the lateral support can be adjusted to the height of the street. It may or may not be glued to the roadway surface or the foundation surface when it is installed.

FIG. 15A is a top view of one of the bottom rails 24 connecting adjacent vertical posts 20. This bottom rail is made out of metal, plastic, or some other hard material. The purpose of the bottom rail is to compress the seal 40 onto the surface of the roadway, thereby creating a water-resistant seal.

FIG. 15B is a perspective view of the bottom rail 24. The holes 68 at each end are for the anchor bolts 46 which hold down the vertical post 20 and the bottom rails 24 to the foundation. Alternatively, the holes 68 can be used to attach the bottom rail to the vertical posts. This may be used when there is no anchor bolt (mechanical fastener) holding down the roadway-levee, but which is held down with glue instead.

Figure 16A:
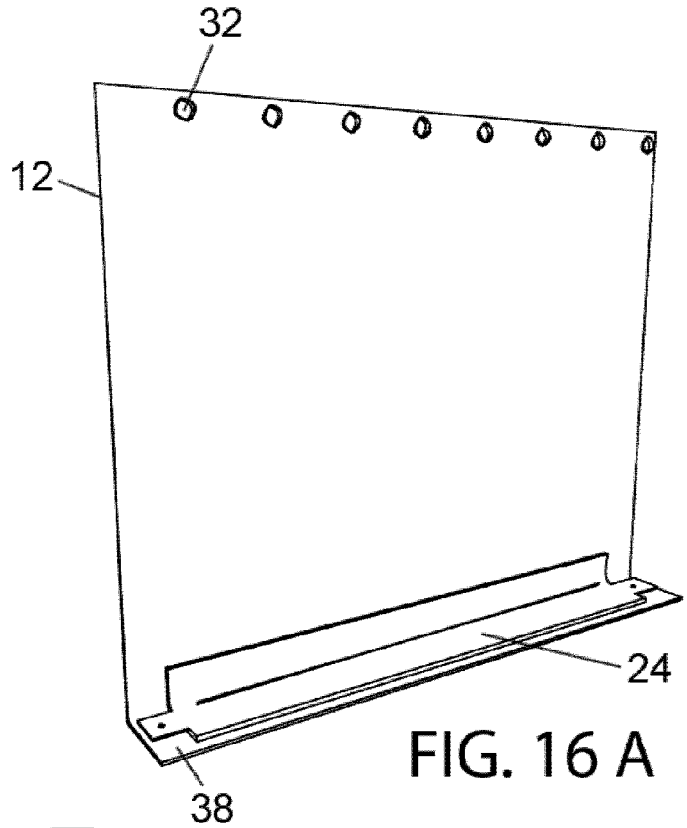
FIG. 16A is a perspective view of the bottom rail overlaying the water-resistant barrier.

FIG. 16A is a perspective view of the bottom rail 24 overlaying the water-resistant barrier 12.

Figure 16B:
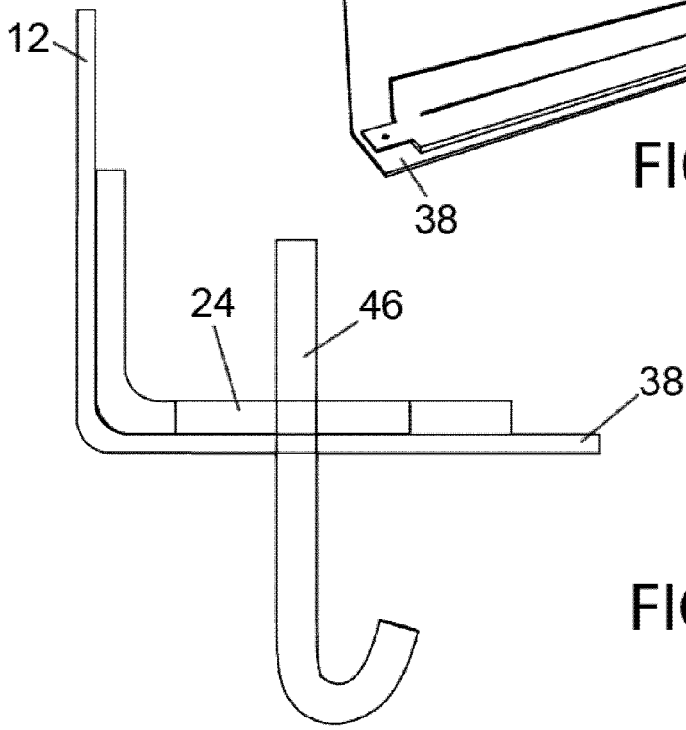
FIG. 16B shows an anchor bolt inserted through the rail and the barrier

FIG. 16B is a side view of a bottom rail 24 overlaying a water-resistant barrier 12 where an anchor bolt 46 is inserted. The anchor bolt 46 connects the foundation 48 (see also FIG. 18) to the water-resistant barrier 12, posts 20 and rails 24 and holds them down and helps create a water-resistant seal.

Figure 17A:
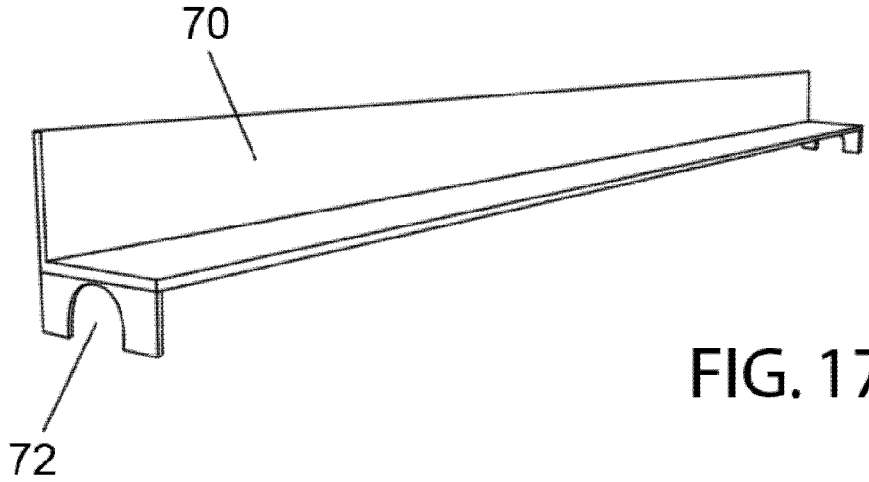
FIG. 17A is a perspective view of one of the mid-level horizontal rails which are fastened between adjacent vertical trusses on one side of the barrier to resist the pressure of water on the other side.

FIG. 17A is a perspective view of one of the mid-level horizontal rails 70, the purpose of which is to provide support to the water-resistant barrier to help resist bowing of the water-resistant barrier when pressure is pressing against it. The holes 72 on the ends of the rails 70 are to enable the rails to be fastened to the posts with a truss pin 74.

Figure 17B:
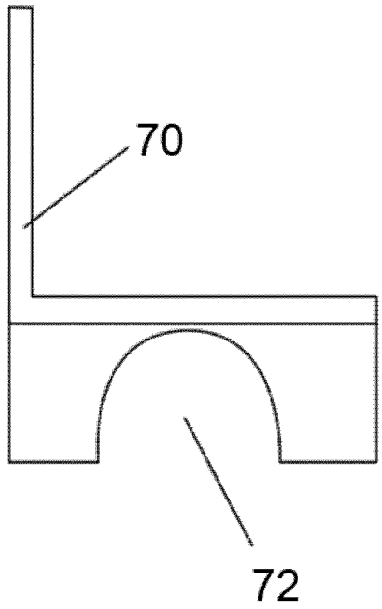
FIG. 17B is an end view of the mid-level horizontal rail.

FIG. 17B is an end view of the mid-level rails. An alternative embodiment is to attach the rails 70 to the posts 20 using a knob that is welded onto the posts, which the holes 72 at either end of rails 70 can fit over.

Figure 17C:
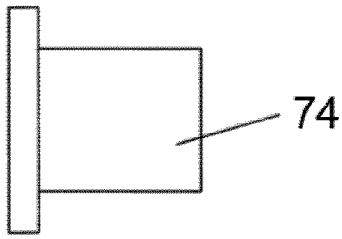
FIG. 17C is a side view of the rail pin that attaches the mid-level rail to the post.

FIG. 17C is a side view of the truss pin 74 that attaches the mid-level rail 70 to the post 20.

FIG. 18 shows perspectives of an intersection scaffold arrangement 76 which may be installed at a four way intersection 30A,30B (FIG. 2) to support and connect the four respective water-resistant barrier portions 78A,78B,78C,78D extending in each of four respective directions from a central core 80. The intersection scaffold arrangement and its central core also seal the four inside corners 82A,82B,82C,82D of the barrier to each other and to the roadway or paved surface 16.

Figure 18A:
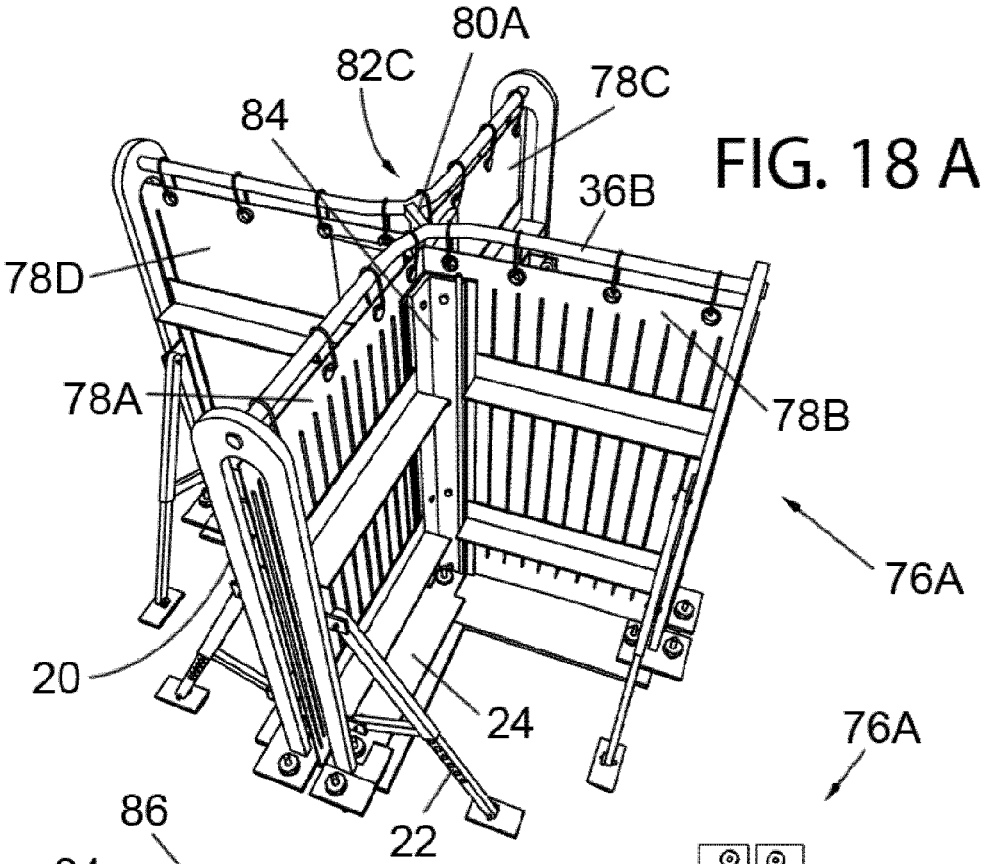
FIG. 18A is a perspective view of an intersection scaffold arrangement having a vertical core from which a respective portion of a water resistant barrier extends in each of four directions to thereby define four respective sectors each associated with a separate protected compartment.

As shown in FIG. 18A, the intersection scaffold 76A may comprise a multiple piece central core 80A with each piece being in the form of a vertical corner post 84 which enables a single sheet of the water-resistant barrier 12 to be installed at a 90-degree turn to thereby form two connected radiating portions 78A,78B, with the vertical corner posts 84 being connected together adjacent a shared vertical axis to thereby form the four respective barrier portions 78A,78B,78C,78D extending in each of four respective horizontal directions. The vertical corner posts and the water-resistant barriers are sealed to each other vertically in a similar fashion as the horizontal bottom seal, using rubber-like vertical seal, thereby forming a central core with four separate protected compartments radiating from the shared vertical axis. Water-resistant glue may be used. The central core and its four respective barrier portions radiating therefrom is held down to the roadway using the same type of foundation, e.g. concrete and steel and anchor bolts, and/or water-resistant glue as the linear portion of the Roadway-levee.

Figure 18B:
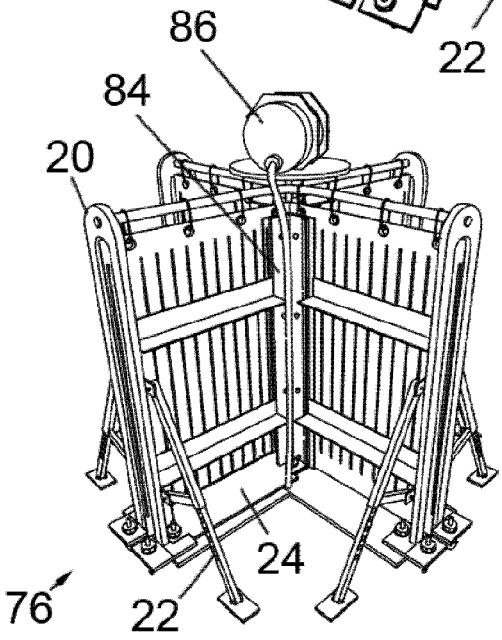
FIG. 18B shows a pump on top of a vertical post for moving water between adjacent compartments.

As shown in FIG. 18B, the central core 80A of the intersection scaffold may have pumps 86 mounted thereon. The pumps direct floodwater out of the area surrounded by the roadway-levee. The pump 86 may also be connected to a water level detector that is connected to a telecommunications device for monitoring water levels offsite. A telecommunications device can be used by a centrally located computer the purpose of which is to control the water level within each roadway-levee-enclosed area 14B,14C,14D,14E.

Figure 18C:
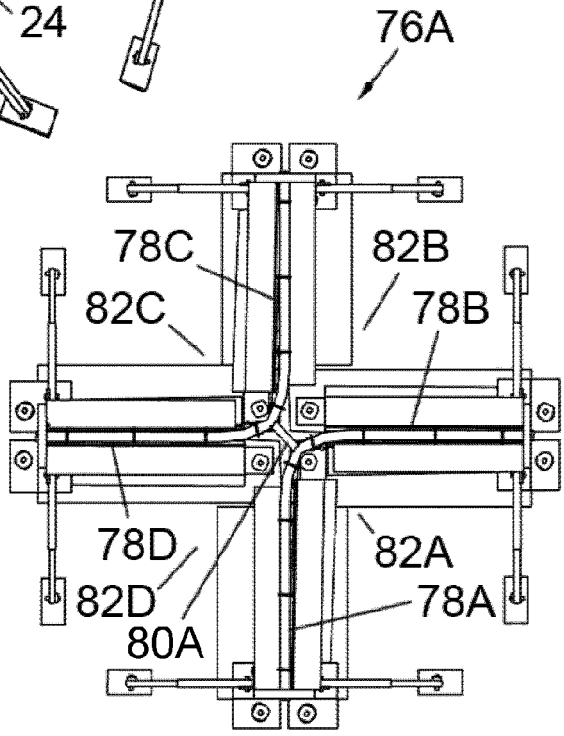
FIG. 18C is a top view of one embodiment of the intersection scaffold arrangement in which the core is formed from a pair of vertical posts each with its respective barriers, seals, supports, and rails.

FIG. 18C is a vertical view of one embodiment of the central core 80A that connects two radiating portions 78A, 78B with the adjacent two other portions 78C,78D. This central core 80A may optionally be provided with valves that open and close directing water in the chosen direction so that the water can be drained out of the roadway-levee.

Figure 19:
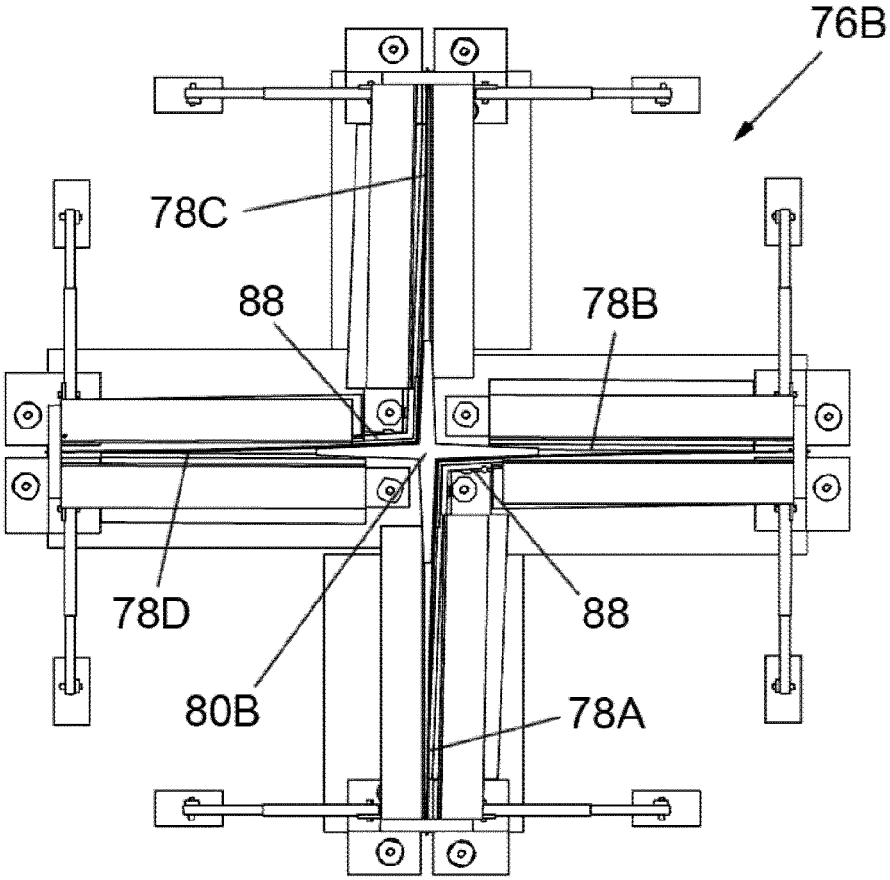
FIG. 19 shows a vertical view of an alternative corner scaffold arrangement with a solid vertical core design.

FIG. 19 shows a vertical view of an alternative intersection scaffold arrangement 76B with a solid core 80B against which the two portions of barrier material 78A,78B radiating from a single sheet 12 are sealed by a respective vertical rail 88, thereby supporting the water-resistant barrier 12 from higher-pressure situations.

As shown in FIGS. 20A and 20B, when a mechanical foundation 48 is used, rather than a glued seal foundation, the foundation consists of concrete and steel foundation that is installed beneath the surface 16 of the roadway prior to flooding.

FIG. 20A is a side cut-away view of a foundation. The depth, diameter and other dimensions will vary depending on the conditions on-site.

FIG. 20B is a perspective view of the same type of foundation. The notch 90 at the top allows for the installation of a cover, that when installed lies flush with the street. When the concrete is poured anchor eyebolts 92 are set into the wet, unhardened concrete at a level under the paved surface. The concrete hardens and creates a heavy mass that serves to immobilize the roadway levee when it is attached thereto.

Figure 21A:
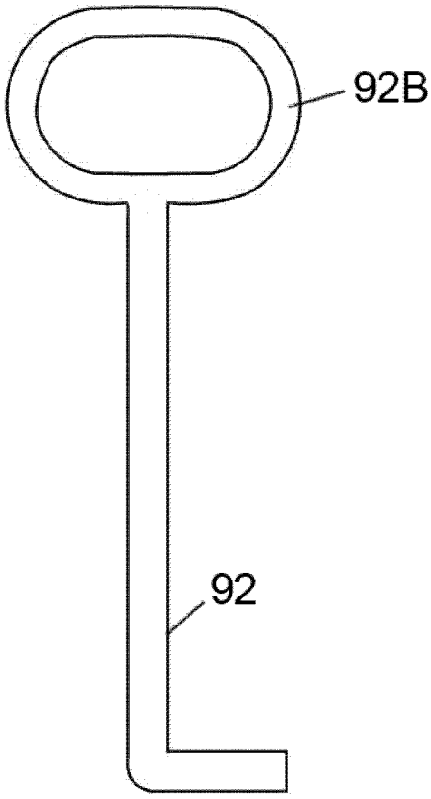
FIG. 21A shows an anchor bolt with an oblong-eye.
Figure 21B:
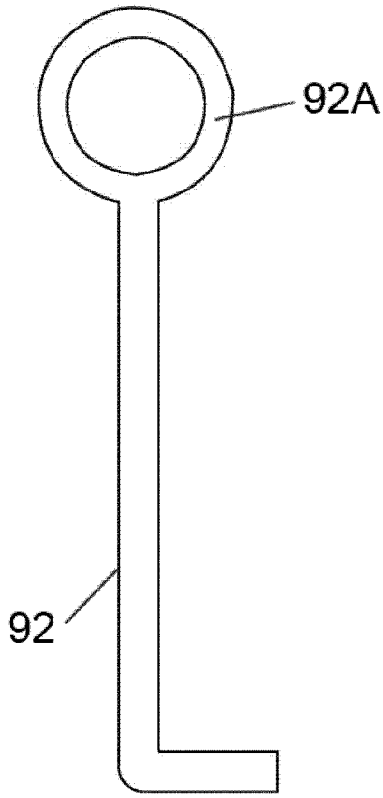
FIG. 21B shows an anchor bolt with a round-eye.

FIG. 21A shows an anchor eyebolt 92A with an oblong-eye and FIG. 21B shows an anchor eyebolt with a round-eye 92B. The purpose of this type of fastener is to allow the use of bolt-hooks that are attached to the trusses and truss laterals when flooding has occurred or is occurring when the roadway-levee is installed. That is to say, when conditions are difficult like they were when Katrina flooded New Orleans. In those conditions, where there are several feet of standing water, regular nuts may not be practicable. The round tops allow hooks to be used so that the trusses may be installed in several feet of water and allow the area within the roadway levee to be drained using pumps.

Figure 22A:
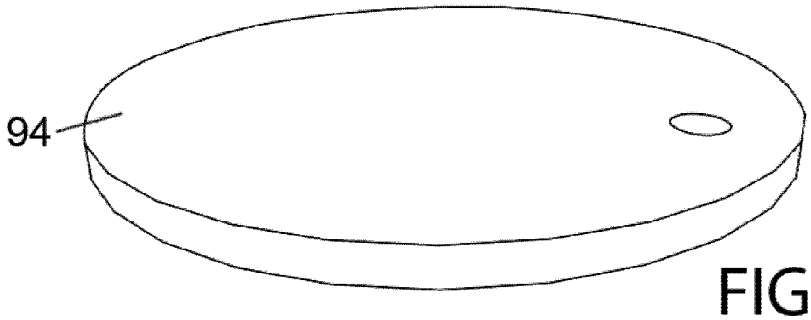

As shown in FIG. 22A, when not in use, the anchor bolts and foundation are covered with a steel cover 94 that is strong enough to allow vehicular traffic to run over it without harming the anchor bolts or the foundation.

Figure 22B:
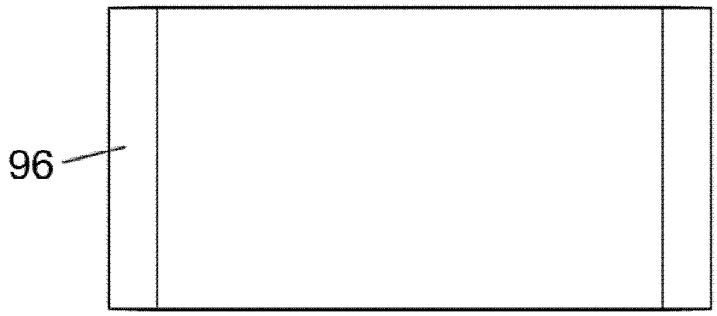
Figure 22C:
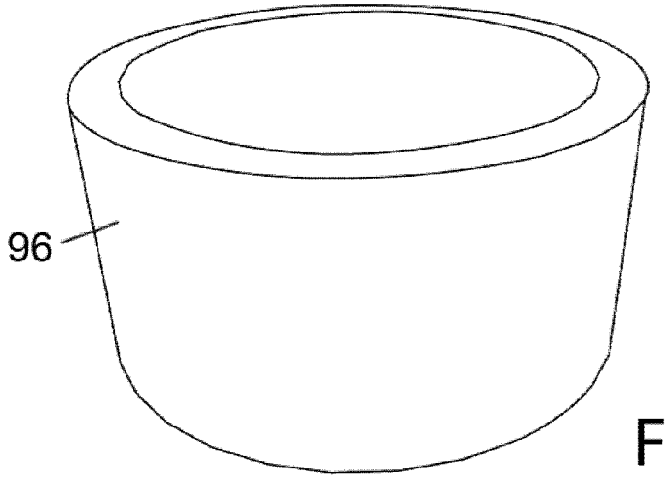

FIG. 22B, is a side cut-away view of the metal ring 96. FIG. 22C is a perspective view of the ring 96. The ring is installed above the foundation 48, and is the base for the steel cover described in FIG. 22A. The steel cover 94 may be provided with a reflector, covers the foundation, so that when it is not being used for the roadway-levee it is a roadway reflector; cover 94 then serves both as a location device and as a street reflector.

Although the description above contains many detailed specifications, these should not be constructed as limiting the scope of the invention but merely providing illustrations of some of the presently preferred embodiments of this invention. For example, the various components can have other shapes, such as triangular, circular, oval, square, trapezoidal, etc.; the seal can have other shapes, and materials, with or without glue, etc.; there may or may not be computer system(s), or pump(s), or water level detector(s). Thus the scope of the invention should be determined by the claims and their legal equivalents, rather than by the examples given.

What is claimed is:

1. A kit of parts for constructing a compartmentalized levee system adapted for temporary erection on intersecting roadways or other paved surfaces by means of which a scaffolding system may be installed above at least some of the intersecting paved surfaces from which may be hung a water resistant barrier material to provide a plurality of protected compartments within an area to be protected, said kit of parts comprising:

at least four vertical posts;

at least one vertical central core;

a plurality of horizontal bottom rails for connecting respective lower portions of said four vertical posts to a shared lower portion of said vertical central core with each of said horizontal bottom rails extending in a different direction from the vertical central core;

at least two sheets of water resistant barrier material;

means for holding up said at least two sheets of water resistant barrier material vertically between each of said four vertical posts and said vertical central core, whereby four respective portions of said water resistant barrier material each extending in a different direction from said vertical central core will define respective portions of four compartments;

means for providing a water resistant horizontal seal under the horizontal bottom rails between a lower portion of said water resistant barrier material and the paved surfaces, and means for providing a water resistant vertical seal between each of four portions of said water resistant barrier material and said vertical central core.

2. The kit of claim 1, further comprising a plurality of mid-level horizontal rails for mounting on either side of the water resistant barrier material to connect said four vertical posts to said vertical central core to thereby resist pressure from differences in water level.

3. The kit of claim 2, further comprising:

a plurality of adjustable lateral supports for connecting an upper portion of at least some of said vertical posts to said paved surface to thereby resist lateral forces from water on one side of the water resistant barrier material.

4. The kit of claim 3, wherein each of said vertical posts further comprises a spring loaded top portion for maintaining tension on the water resistant barrier material.

5. The kit of claim 3, further comprising:

a pump adapted to be mounted on the at least one vertical central core for directing water in a chosen direction.

6. The kit of claim 3, further comprising a plurality of said vertical central core, vertical posts, horizontal bottom rails, mid-level horizontal rails, and adjustable lateral supports for constructing a two dimensional array of at least four adjacent said protected compartments arranged in a two by two array.

7. The kit of claim 3, wherein said vertical central core comprises a plurality of vertical corner posts adapted to be connected to each other adjacent a shared vertical axis and sealed to the barrier material with respective barrier portions radiating from the shared vertical axis.

8. The kit of claim 3, wherein said vertical central core comprises a solid core and at least two vertical rails each adapted to seal two respective radiating portions of the barrier material against the solid core.

9. A compartmentalized levee system for temporary erection on intersecting roadways or other paved surfaces with a two dimensional array of at least four adjacent protected compartments, said levee system comprising:

at least four vertical posts;

at least one vertical central core;

a plurality of horizontal bottom rails connecting respective lower portions of said vertical posts to each other and to a shared lower portion of said vertical central core with each of said horizontal bottom rails extending in a different direction from the vertical central core;

at least two sheets of water resistant barrier material;

first means extending between an upper end of each of said four vertical posts and the vertical central core for hanging four respective upper portions of said water resistant barrier material each extending in a different direction from the vertical central core, to thereby define respective portions of said four compartments;

second means for providing a water resistant horizontal seal under the horizontal bottom rails between a lower portion of said water resistant barrier material and the paved surfaces; and third means for providing a water resistant vertical seal between each of four portions of said water resistant barrier material and the vertical central core.

10. The levee system of claim 9, further comprising a plurality of mid-level horizontal rails connecting said four vertical posts to said vertical central core and disposed on either side of the barrier material for resisting pressure from differences in water level in said compartments.

11. The levee system of claim 10, further comprising:

a plurality of adjustable lateral supports for connecting an upper portion of at least some of said vertical posts to said paved surfaces thereby resisting lateral forces from water on one side of the water resistant barrier material.

12. The levee system of claim 11, wherein each of said vertical posts further comprises a spring loaded top portion for maintaining tension on the on the water resistant barrier material.

13. The levee system of claim 12, further comprising:

a pump mounted on said vertical central core for directing water in a chosen direction from one of said compartments to another of said compartments.

* * * * *